United States Patent [19]

Brown, II

[11] Patent Number: 4,691,522

[45] Date of Patent: Sep. 8, 1987

[54] SOLAR POWER GENERATION

[76] Inventor: William G. Brown, II, 720 NW. 31st St., Corvallis, Oreg. 97330

[21] Appl. No.: 765,823

[22] Filed: Aug. 14, 1985

Related U.S. Application Data

[60] Division of Ser. No. 486,087, Apr. 18, 1983, Pat. No. 4,549,604, which is a continuation-in-part of Ser. No. 122,357, Feb. 14, 1980, abandoned, which is a continuation-in-part of Ser. No. 816,501, Jul. 17, 1977, abandoned, which is a continuation-in-part of Ser. No. 788,207, Apr. 18, 1977, abandoned.

[51] Int. Cl.[4] ..... F03G 7/02

[52] U.S. Cl. ..... 60/641.8; 60/649; 60/673; 60/689

[58] Field of Search ..... 60/641.8, 641.9, 649, 60/670, 673, 685, 689; 126/263; 122/21

[56] References Cited

U.S. PATENT DOCUMENTS

| | | | |
|---|---|---|---|
| 287,937 | 11/1883 | Honigmann | 60/649 |
| 2,005,377 | 6/1935 | Kasley | 122/21 |
| 4,122,680 | 10/1978 | Isshiki et al. | 60/649 |
| 4,606,192 | 8/1986 | Brown, II | 60/641.8 |

FOREIGN PATENT DOCUMENTS

| | | | |
|---|---|---|---|
| 716665 | 10/1954 | United Kingdom | 122/21 |

*Primary Examiner*—Stephen F. Husar

[57] ABSTRACT

A solar electric power generating process is described which consists of tapwater thermally contacted with special brine. Low pressure characteristics of the brine draw steam through a power generating turbine from the water into the brine. As the brine is pumped over an open air evaporator, excess water picked up by the brine is driven off using solar or waste heat.

21 Claims, 12 Drawing Figures

SOLAR POWER GENERATION

REFERENCE TO RELATED PATENT APPLICATIONS

The present patent application is a division of U.S. patent application Ser. No. 486,087, entitled SOLAR POWER GENERATION by William G. Brown, filed Apr. 18, 1983, now U.S. Pat. No. 4,549,604, which in turn is a continuation-in-part of U.S. patent application Ser. No. 122,357, filed Feb. 14, 1980, now abandoned, which in turn is a continuation-in-part of U.S. patent application Ser. No. 816,501, filed July 17, 1977, now abandoned, which in turn is a continuation-in-part of U.S. patent application Ser. No. 788,207, filed Apr. 18, 1977, also now abandoned.

BACKGROUND OF THE INVENTION

The present invention relates to an absorption process using a desiccant brine as a working fluid to capture solar or waste heat using the combination of an air evaporator and vacuum boiler.

Kasley, U.S. patent Ser. No. 2,005,377, 1935, describes an absorption power plant using an inexpensive open-air evaporator and using tapwater as boiler feedwater. His plant uses the evaporative capacity of air to drive water from brine in an open cycle and thereby benefits from improved cycle efficiency and reduced costs. However, his plant also preheats water and brine streams to high temperatures and boils water directly to steam promoting undesirable corrosion and mineral deposits which may offset the great advantage of the open evaporator. Soddy, Great Britain, patent Ser. No. 716,665, 1954, and Isshiki, U.S. patent Ser. No. 4,122,688, 1978, describe low temperature (vacuum) processes and Natanson, U.S. patent Ser. No. 377,300, 1885, describes an indirect, flash-boiling process, but neither use the evaporative capacity of air to drive water from liquid desiccant brine in an open cycle. Features of the present invention described herein make the inexpensive, open evaporator practicable.

SUMMARY OF THE INVENTION

One object of the invention is to use inexpensive feedwater containing minerals and yet not hinder boiler operation by deposition of minerals and by corrosion on heat transfer surfaces. Another object is to use an inexpensive evaporator for capturing solar or waste heat. Still another object is to exploit the evaporative capacity of air for enriching a desiccant to produce power. Yet another object is to use an inexpensive, benign desiccant brine. Still another object is to operate the process at above ambient temperatures using counterflow heat exchangers, and yet not overcool the desiccant streams. Yet another object is to reconcentrate the desiccant at maximum efficiency. Still another object is to produce a maximum yield in kilowatthours per dollar of equipment.

BRIEF DESCRIPTION OF THE DRAWINGS

Other objects of the present invention will become more apparent from the following detailed description of preferred embodiments thereof and from the attached drawings of which.

DETAILED DESCRIPTION OF PREFERRED EMBODIMENTS

Figure 1:
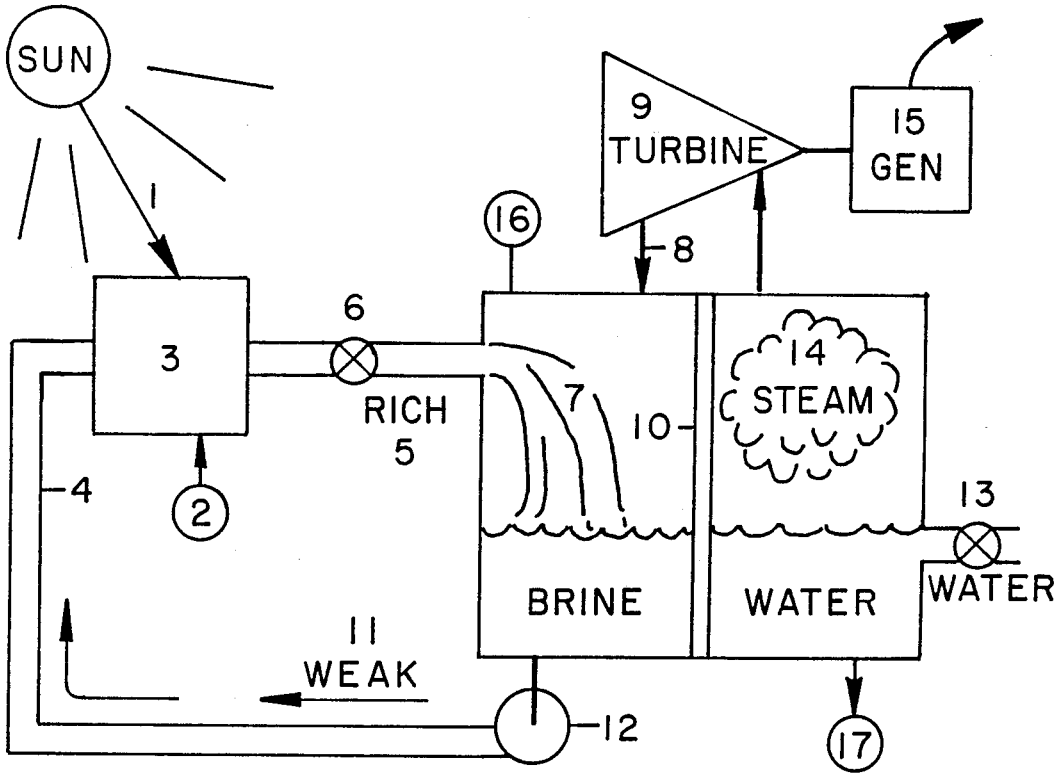
FIG. 1 is a schematic representation of a simplified absorption power plant.

FIG. 1 is a schematic representation of a simplified embodiment of the absorption plant for generating power. Solar energy 1 or waste heat 2 warming the open evaporator 3 drives excess water off weakened brine 4 producing rich brine 5. Rich brine 5 then advances through valve 6 (designated as a circled X in the diagrams) and into the vacuum absorber chamber 7. Due to the low pressure characteristics of the brine, low pressure steam 8 is drawn into the brine from the turbine 9. As the brine absorbs the steam, it evolves heat to the heat transfer surface 10 and becomes weakened brine 11 to be pumped 12 back to the evaporator 3 to be recycled again. Meanwhile, a stream of water 13 contacting the heat transfer surface 10 absorbs the heat previously evolved and boils to high pressure steam 14. The steam 14 then flows through the turbine 9 turning the generator 15 to produce electricity. Residual noncondensible gases from the low pressure steam are removed by vacuum pump 16, and accumulated minerals removed from the water stream through blow down line 17.

Note that the terms 'high pressure steam', 'intermediate pressure steam' and 'low pressure steam' are relative, and that the high pressure steam may actually be at a subatmospheric pressure. As defined here, intermediate pressure steam will condense at a temperature at least one degree Celsius lower than will high pressure steam. Note also that the term 'rich desiccant' (the same as 'concentrated desiccant') and 'weakened desiccant' may actually be 50% by weight calcium chloride, for example. The term 'substantially calcium chloride brine' is meant to define a brine in which calcium chloride comprises at least 90% by weight of the salt content of that brine. A concentrated desiccant, as defined here, has a boiling point elevation of at least 12 degrees Celsius (at 112 degrees Celsius, it will absorb steam at standard atmospheric pressure). Water, as defined here, will boil at less than 105 degrees Celsius at standard atmospheric pressure. In addition, the term 'turbine' is meant to include any engine suitable for expanding steamto generate power. As well, note that the term "air evaporator" refers to an evaporator for concentrating a desiccant in which the atmosphere in contact with the desiccant comprises at least half air. The term "open air evaporator" refers to an evaporator for concentrating a desiccant wherein at least half the water driven off the desiccant is not recondensed but travels out into the earth's atmosphere and is not recovered in the process. Finally, the term 'stream' is not meant to be limited to continuous flow. The stream of water 13, for example may be intermittent while contact with the surface 10 may be continuous.

Figure 2:
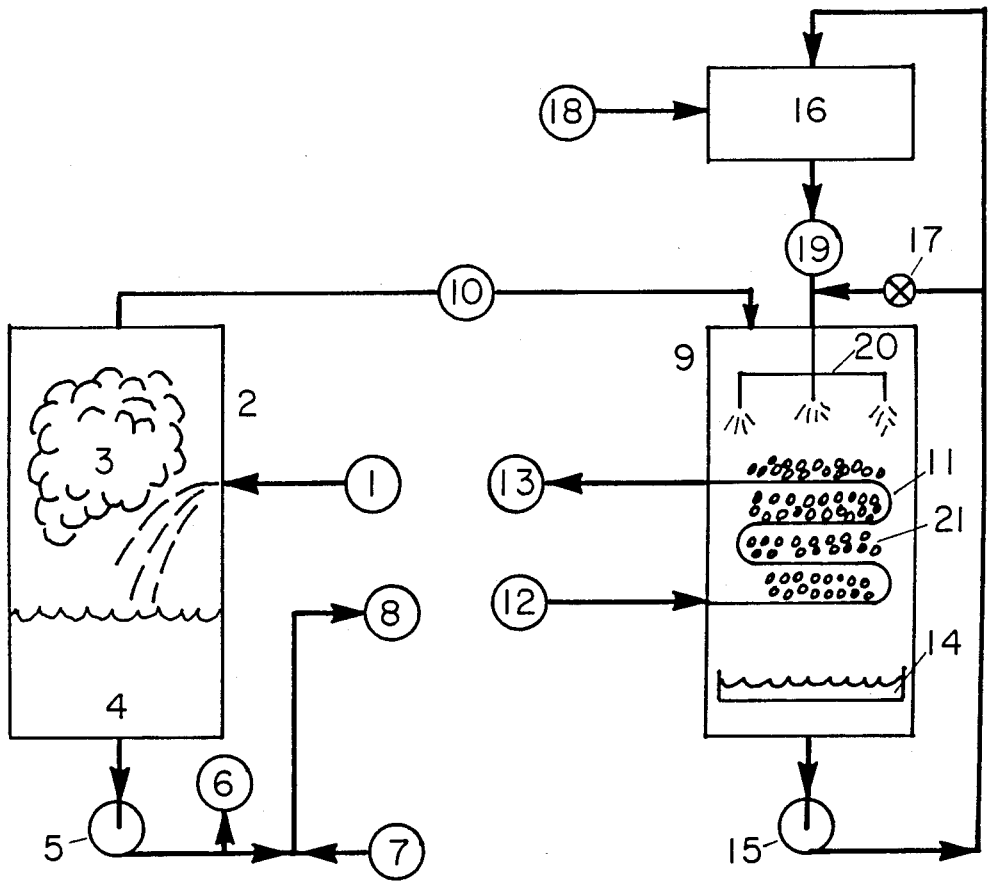
FIG. 2 is a schematic representation of an absorption process which may be used for heating and refrigeration or for power generation.

FIG. 2 is a schematic representation of an absorption process which may be used for heating and refrigeration or for power generation. Water 1 entering the flash chamber 2 flashes to steam 3 cooling the remainder 4 which is pumped 5 out of the flash chamber 2. To prevent build up of solids in the water, a small fraction may be blown down line 6, and along with the flashed portion, replaced with water from line 7 to form stream 8. Meanwhile, due to the low pressure characteristics of the desiccant in the absorber chamber 9, steam 3 is drawn into absorber 9 through the duct 10. For generating power as claimed in this invention, the duct 10 comprises a turbine, through which steam is expanded to generate power. As the desiccant absorbs steam, it releases heat to the heat transfer surface of the coils 11 heating the stream of water 12 to a higher temperature stream 13 after absorbing the steam, the weakened desiccant falls into the catch pan 14 and is pumped 15 to the evaporator 16 and also recycled through the valve 17 to create more flow over the heat transfer surface of the coils 11. Weakened dessicant in the evaporator 16 absorbs heat 18 from solar energy or waste heat as from a thermoelectric power plant. Excess water evaporates off the weakened desiccant leaving rich dessicant 19 which flows back into the absorber 9 through a distributor 20. The desiccant flows over the coils which may be interspersed with packing material 21 to provide increased surface area to aid in the absorption of steam. The heated stream 13 is returned to the flash chamber 2 as stream 1 to generate steam, and the cooler stream 8 is returned to the absorber 9 as stream 12 to absorb more heat. The flash chamber, as defined here, produces more than half its steam using heat derived from the sensible heat in the stream of water entering the flash chamber and not from any additional source of heat such as a heating coil; the flash chamber is substantially adiabatic.

Figure 3:
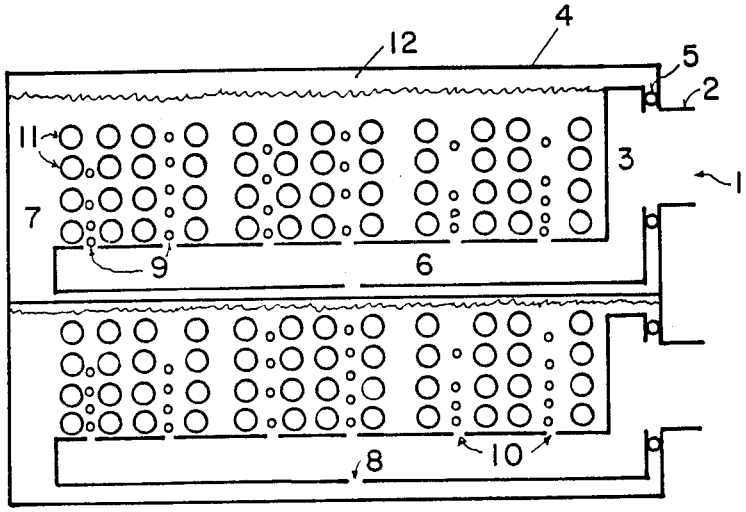
FIG. 3 is a cross-sectional end view of a submerged absorber.

FIG. 3 is a cross-sectional end view of a submerged absorber suitable for absorbing steam into a desiccant. Steam 1 enters through the port 2 into the duct 3 sealed from the upper absorber chamber 4 by the O-ring seal 5 and flows into the perforated box 6 submerged in brine 7. The steam displaces brine from the box, pushing brine out through the drain hole 8 and steam bubbles 9 out into the brine through the perforations 10. Slight positive pressure of steam in the box keeps brine out. As the brine absorbs steam bubbles 9, it warms up and heats the tubes 11. Residual steam and noncondensible gases rise to the vapor space 12 above the liquid level. In the preferred embodiment shown, steam is absorbed into and heats the brine in the absorber chamber 4, the heat then flowing through the walls of the tubes 11 which comprise the heat transfer surface, to heat water in the space within the tubes 11 which comprises the heating chamber.

Figure 4:
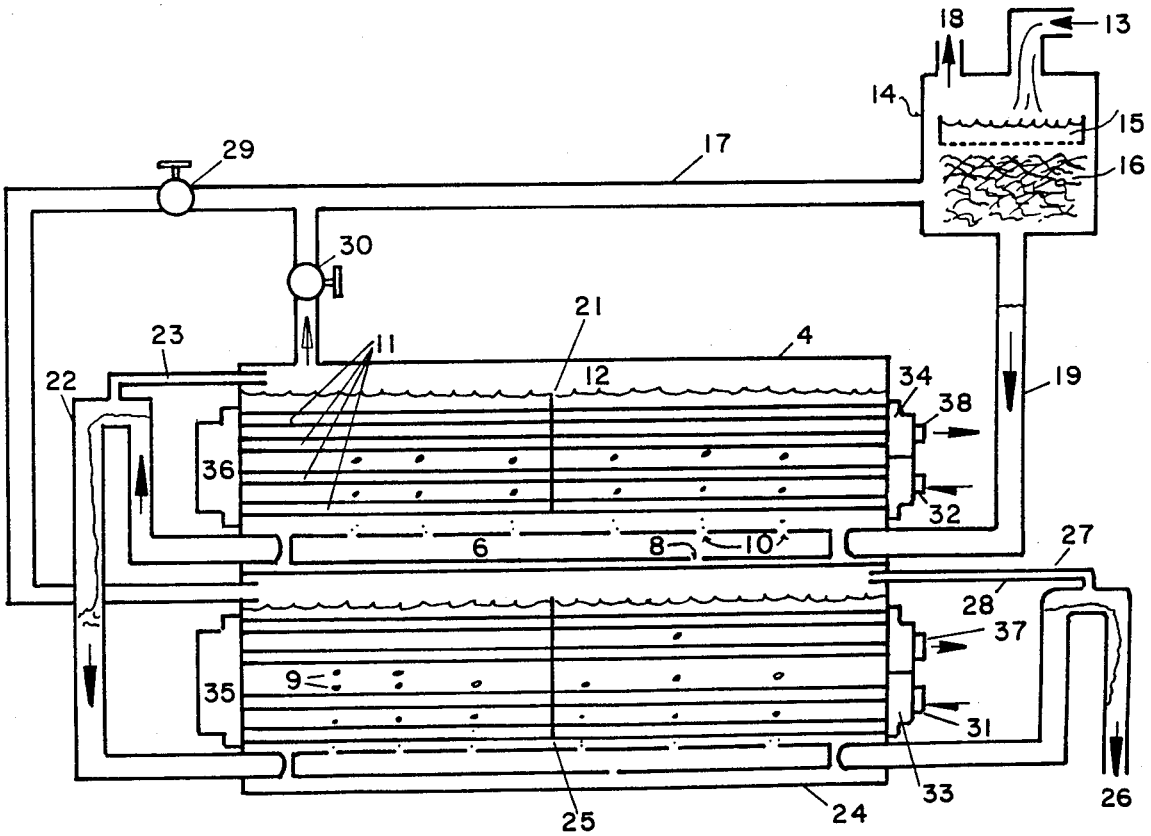
FIG. 4 is a cut-away side view of the submerged absorber shown in the previous figure.

FIG. 4 is a cut-away side view of the submerged absorber described in the preceding figure. Rich brine 13 flows into the purge chamber 14 and within into a perforated tray 15 to be distributed over the packing 16. The brine spreads out over a greater surface area due to the packing 16 which aids in absorbing residual steam 17 from the vapor spaces 12 leaving behind concentrated noncondensible gases to be vented 18. The rich brine then flows down the drain 19 and into the upper absorber chamber 4. Here it absorbs steam bubbles 9 and becomes slightly weaker 20 as it flows past divider 21 toward U-tube 22. The brine will not siphon out of the U-tube 22 due to the anti-siphon tube 23. The brine, weaker still, flows down U-tube 22 into the lower absorber compartment 24. The brine absorbs steam and becomes slightly weaker as it advances past the divider 25. Note that the dividers 21 and 25 aid in preventing weaker brine from mixing with richer brine upstream, and in this sense provide a degree of isolation as the brine flows through the absorber as do the two separate compartments 4 and 24. Finally the weakened brine 26 drains out of the U-tube 27 prevented from siphoning by the tube 28.

Residual steam and noncondensibles accumulate in the vapor spaces 12 and are drawn off through the throttling valves 29 and 30 which serve to balance steam flow between the compartments 4 and 24 by creating back pressure in a compartment receiving excess steam. Residual steam is defines as steam with a higher concentration of noncondensible gases than steam entering the absorber and which fails to be absorbed into the desiccant in the absorber chamber.

Heat is generated as steam is absorbed into the brine and heats the outsides of the tubes 11. Water streams 31 and 32 entering the lower compartments of the bonnets 33 and 34 are heated within the tubes 11 before emerging into the bonnets 35 and 36 and then further heated in the tubes before returning to the upper compartments of the bonnets 33 and 34 and emerging as the streams 37 and 38.

Figure 5:
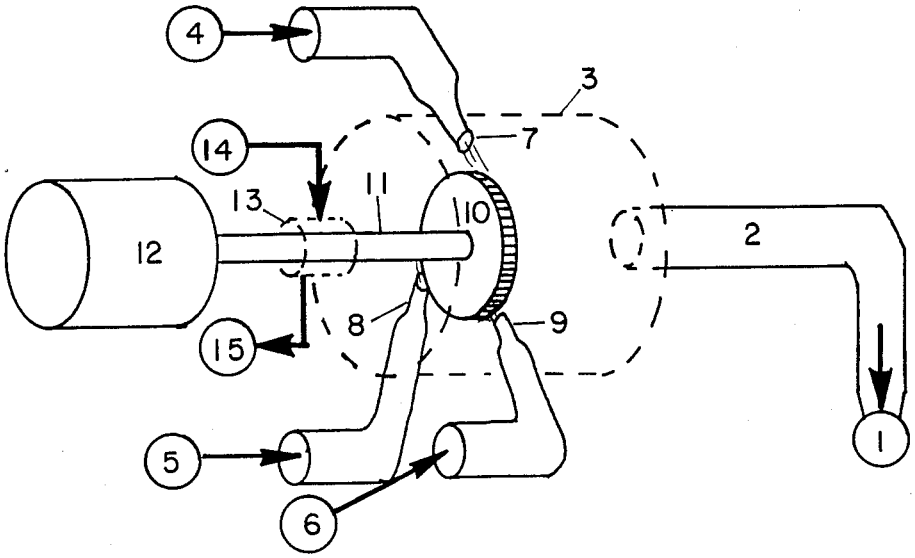
FIG. 5 is a perspective view of a steam turbine suitable for an absorption power plant.

FIG. 5 is a perspective view of a steam turbine assembly suitable for generating electricity in an absorption power plant. Low pressure steam 1 exhausts from the exhaust duct 2 connected to the housing 3. Steams 4, 5 and 6 of high pressure steam, not necessarily of the same pressure, emerge through the jets 7, 8, and 9 at high velocity against the turbine wheel 10 turning the shaft 11 which turns the generator 12 through the bearing 13. Water stream 14 cools and lubricated the bearing 13 and is discharged slightly warmer as the stream 15. The water also serves as a seal preventing air from leaking into the exhaust steam and does not contaminate the process as might oil lubricants.

Figure 6:
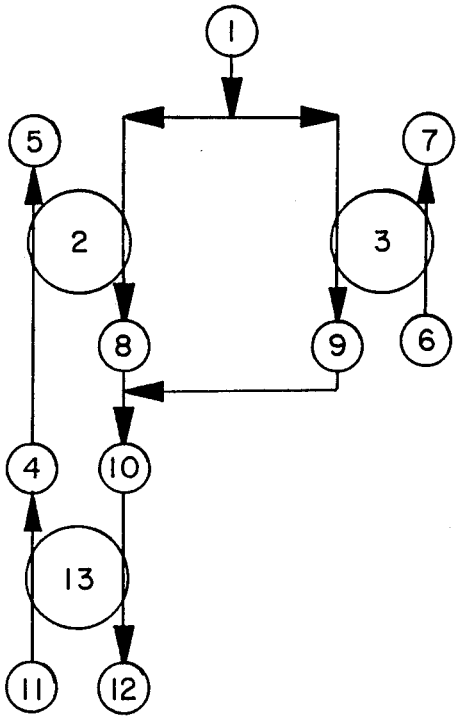
FIG. 6 is a schematic representation of a counterflow heat exchanger arrangement for preheating desiccaant and feedwater.

FIG. 6 is a schematic representation of a counterflow heat exchanger configuration suitable for preheating the feedwater and rich brine streams prior to introduction of these streams into the flash boiler and absorber respectively. As a heat source to accomplish this heating, hot weak brine is used which is discharged from the absorber. As the weak brine gives up its heat to warm the incoming streams, it becomes cool. Ideally, to warm these incoming streams as much as possible, as much heat as possible is extracted from the weak brine stream, thus cooling the weak brine as much as possible. It is important to extract the heat evenly to cool the weak brine without overcooling to avoid crystallizing the weak brine. Weak brine 1 from the absorber is split to feed the counterflow heat exchangers 2 and 3. A first portion of weak brine warms the feedwater stream 4 from intermediate temperature to warmest temperature 5 and a second portion to warm the cool rich brine stream 6 to warmest temperature 7. Weak brine streams 8 and 9 from the heat exchangers are then remerged to form stream 10 to warm the incoming cold feedwater 11 to intermediate temperature. Due to the combined high flow rate of the stream 10, the weak brine is less susceptible to overcooling during contact with the cold feedwater. The stream 10 emerges without crystallizing as the stream 12 from the heat exchanger 13. As well, the apportioned flow rates of streams 8 and 9 achieve maximum heating of the feedwater and rich brine streams.

Figure 7:
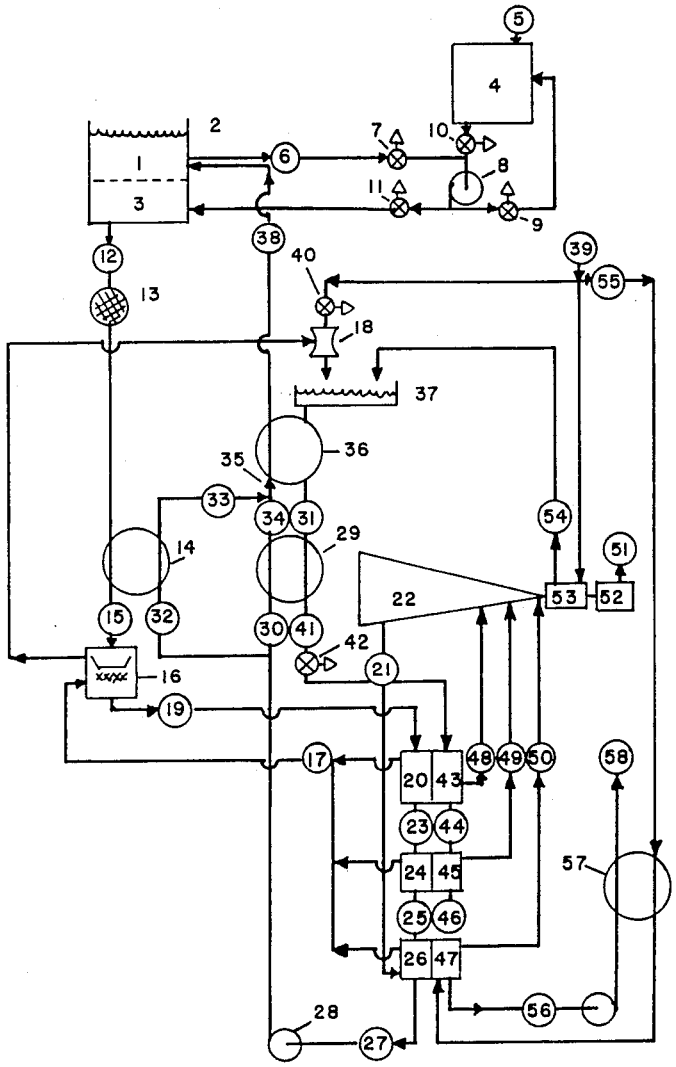
FIG. 7 is a schematic representation of an absorption power plant suitable for efficient generation.

FIG. 7 is a schematic representation of an absorption power plant suitable for producing power efficiently. Weak brine 1, in the pond 2, floating above a layer of rich brine 3 is drawn onto the evaporator 4 to be enriched using solar energy or waste heat 5 as from a thermoelectric power plant such as is commonly used by the public utilities. The weak brine is drawn through the line 6, through the control valve 7, into the pump 8 and through another control valve 9 before reaching the evaporator 4. After draining from the evaporator, the brine enters a third control valve 10 and recirculates through the pump 8 and over the evaporator until it is sufficiently enriched. Then a fourth control valve 11 opens, discharging the rich brine into the rich brine layer 3 of the pond 2. The rich brine 12 is then drawn out through a suitable strainer 13 and into the heat exchanger 14 where it is heated for example, from 40 degrees Celsius to 80 degrees Celcius. The heated rich brine 15 advances to the purge chamber 16. Residual steam and noncondensibles stream 17 is partially absorbed by the rich brine before being drawn into the jet ejector vacuum pump 18. The rich brine 19 then advances to the rich absorber 20 where it absorbs exhaust steam 21 from the turbine 22. The rich brine, somewhat weaker 23, then pours into the intermediate absorber 24 and absorbs still more exhaust steam 21. It finally advances 25 to the weak absorber 26 and also absorbs steam 21 and emerges as the hot weak brine stream 27. (For purposes of describing the process, note that the rich, intermediate and weak absorbers may be considered as a single absorber with real or imaginary divisions into first, second and third portions.) The hot weak brine is then pumped 28 to the heat exchangers 14 and 29 where a first portion 30 is split off to heat the intermediate temperature feedwater 31 in heat exchanger 29 and a second portion 32 to heat the rich brine stream 12. The somewhat cooled, intermediate temperature brine streams 33 and 34 are then remerged 35 and advanced to heat exchanger 36 to heat the feedwater from the separator 37. The cooled weak brine stream 38 is then discharged into the layer of weak brine 1 in the pond 2.

At the same time, pressurized, cold feedwater 39 is fed through the control valve 40 into the jet ejector 18 used to maintain vacuum on the system. It discharges as feedwater into a receiving pan or separator 37 which serves to separate air from the water. The feedwater is then preheated in the heat exchanger 36 and ultimately heated to hot feedwater 41 and admitted through the control valve 42 into the boiler 43. Excess water 44 from boiler 43 spills into boiler 45. Excess water 46 from the boiler from the boiler 45 spills into the boiler 47. Due to the rich brine fed into the rich absorber 20, the rich absorber operates at a higher temperature than the intermediate and weak absorbers. The rich brine heats the adjacent boiler 43, which in turn generates steam 48 at a higher pressure than the corresponding intermediate temperature steam 49 and steam 50 from the boilers 45 and 47. By keeping the steam streams separate and not mixing them together to the lowest pressure, higher power output 51 is attained from the turbine 22 and generator 52. The boilers 43 and 45 are also referred to as the first and second boilers respectively. Pressurized feedwater 39 also cools and lubricates the turbine bearing 53 before being discharged 54 for use as feedwater (and will not contaminate as oil would). Also, a portion 55 of feedwater 39 is directed as replacement for boiler blowdown 56 and preheated in the counterflow heat exchanger 57 using heat from the outgoing stream of blowdown 56 cooled and discharged as stream 58.

Figure 8:
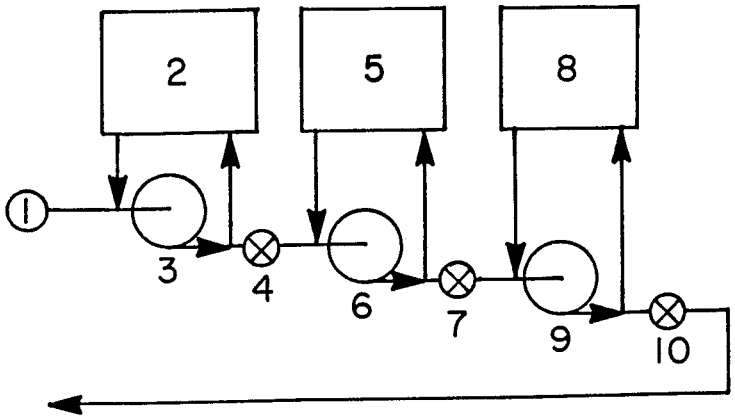
FIG. 8 is a schematic representation of a concentrating evaporator process.

FIG. 8 shows a schematic representation of an evaporator process suitable for concentrating brine for the power plant. Weakened desiccant 1 advances to the evaporator 2 where pump 3 maintains recycle over the evaporator 2. On account of water being driven from the desiccant, the desiccant is gradually enriched. The desiccant passes through the throttling valve 4 to evaporator 5 at slightly higher concentration and is similarly recycled and advanced by the pump 6 through the throttling valve 7 to the evaporator 8. After similar recycle over the evaporator 8 by pump 9, the desiccant is sufficiently enriched and is withdrawn continuously through the throttling valve 10. In the multiple evaporator process just described, the average concentration of the desiccant in the three evaporators is lower than the final concentration as would be withdrawn from a single recycling evaporator, thus increasing the evaporation efficiency which happens to be more favorable at a lower average concentration. The term 'evaporation zone' is meant to refer to the active area of the evaporator such as the evaporators 2, 5 and 8.

Figure 9:
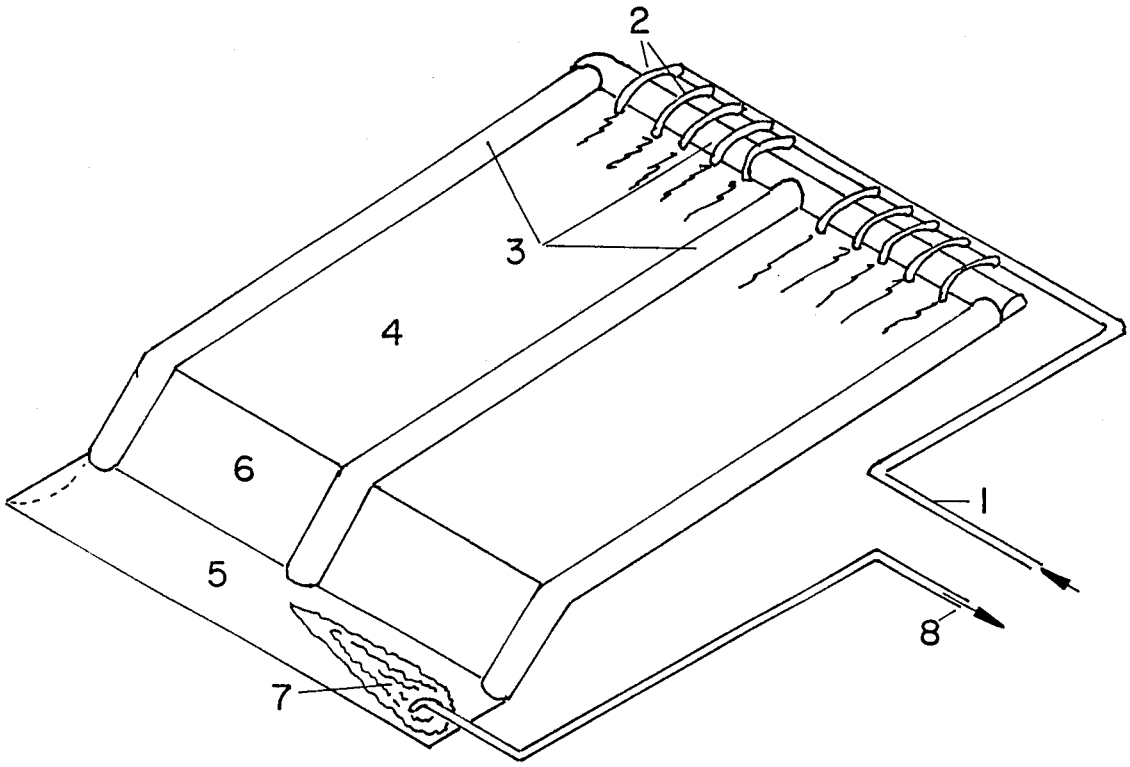
FIG. 9 is a perspective view of an open, flat, concentrating evaporator.

FIG. 9 is a perspective view of an open, flat evaporator suitable for reconcentrating brine. Weak brine is pumped out to the evaporator through the line 1 and distributed onto the upper side of the evaporator surface through the distributor tubes 2. The dikes 3 confine brine to the evaporator surface 4 which has flat channels to direct the flow of brine from the distributor tubes to the sump 5. A steeper grade 6 just prior to the brine reaching the sump serves to prevent brine from leaking backward underneath overlapping membranes near the sump. Richer brine 7 collecting in the sump is drawn out through the line 8.

Figure 10:
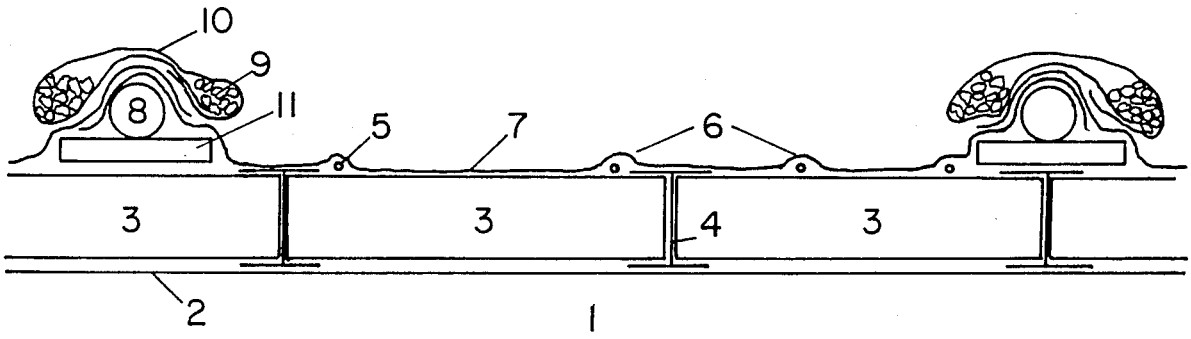
FIG. 10 is cross-sectional view of the evaporator shown in the preceding figure.

FIG. 10 is a cross-sectional view of an open, flat evaporator. From the ground 1 up, it consists of a waterproof membrane 2, flat insulating boards 3 to retain heat on the evaporator, with the boards 3 maintained at an even elevation relative to one another by the sandwiching plates 4. On top of the insulating boards are laid the ropes 5 to form the ridges 6 to channel the brine over the flexible, waterproof membrane 7. Discrete, overlapping membranes are sealed without joining by overlapping the edges over a suitable pipe 8 and weighting down the pipe and edges with the gravel 9. The gravel is secured with the rain resistant membrane 10. The membrane tube and gravel is kept elevated and free from brine by the boards 11.

Figure 11:
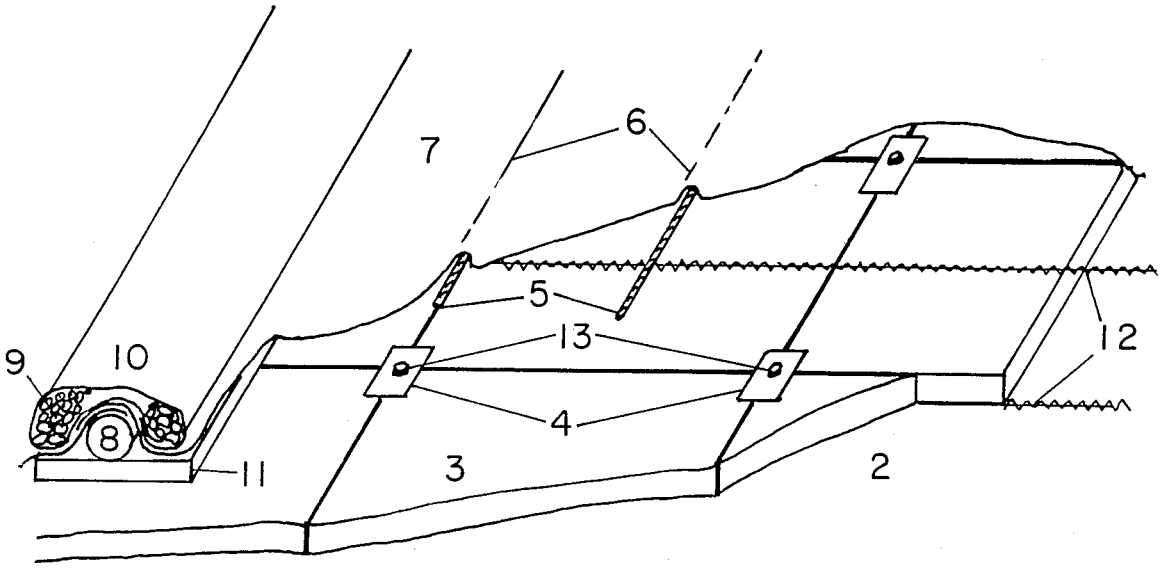
FIG. 11 is a cut-away view of the evaporator shown in the preceding figure.

FIG. 11 is a cut-away view of the open, flat evaporator described above. Also shown are the leak detectors 12 and the heat ot the bolt 13 which compresses the retainer plates 4 together. The leak detectors consist of twisted wire with insulation permeable to liquid. Presence of brine conducts a current between the two conductors and may cause an alarm to sound.

Figure 12:
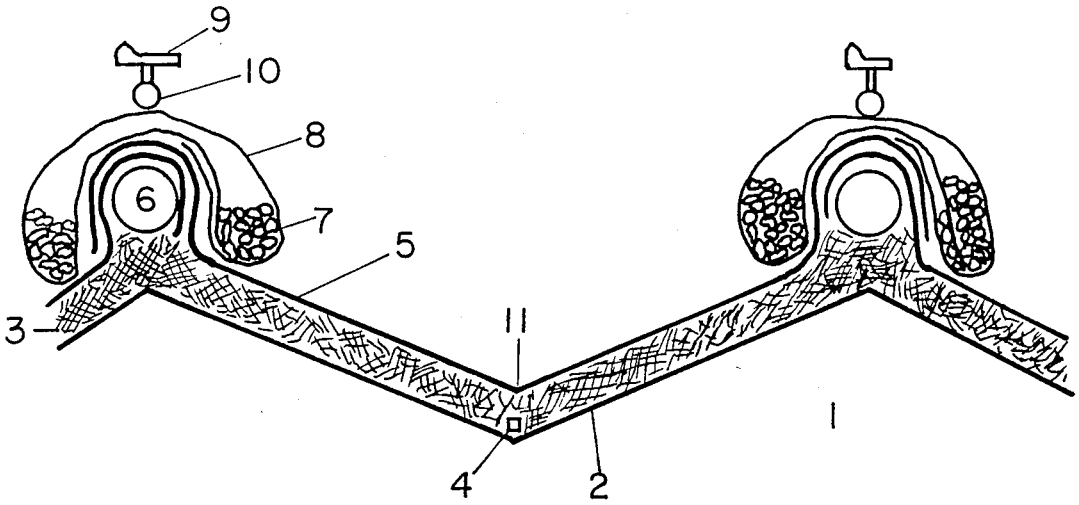
FIG. 12 is a cross-sectional view of an open, sprinkled, concentrating evaporator.

FIG. 12 shows a cross-sectional view of an open, sprinkled evaporator. The evaporator is laid on the ground 1 having a pronounced grade to discourage puddling. From the ground up is laid the waterproof membrane 2, insulation such as wood shavings 3, a leak detector 4 at the trough of the grade, another waterproof membrane 5, the pipe 6, gravel 7 and membrane tube 8 as described previously to secure the edges of the membrane 7, a set of sprinklers 9 and brine supply piping 10. Brine is sprinkled over a substantial area of the evaporator surface and flows down into the trough 11 to drain back into the sump.

It will be obvious to those having skill in the art that many changes may be made in the preferred embodiments of the invention. Therefore, the scope of the present invention should only be determined by the following claims.

What is claimed is:

1. An absorption power generating process comprising:

injecting low pressure steam at a subatmospheric pressure into an absorber chamber;

injecting a rich desiccant into said absorber chamber;

absorbing at least a portion of said low pressure steam into said rich desiccant to release heat from said desiccant and produce a weakened desiccant;

removing at least a portion of said weakened desiccant from said absorber chamber;

vaporizing at least a portion of the water from said weakened desiccant in an atmosphere of air to enrich said weakened desiccant;

transferring said released heat from said absorber chamber to a stream of water to produce high pressure steam;

expanding said high pressure steam through a turbine to produce power and low pressure steam.

2. The process according to claim 1 wherein said high pressure steam is at a subatmospheric pressure.

3. The process according to claims 1 or 2 wherein said desiccant is enriched on an open evaporator.

4. An absorption power generating process comprising:

injecting low pressure steam into an absorber chamber;

injecting a rich desiccant into said absorber chamber;

absorbing at least a portion of said low pressure steam into said rich desiccant to release heat from said desiccant and produce a weakened desiccant;

removing at least a portion of said weakened desiccant from said absorber chamber;

vaporizing at least a portion of the water from said weakened desiccant in an atmosphere of air to enrich said weakened desiccant;

transferring said released heat from said absorber chamber to a stream of water and producing high pressure steam from said stream of water in a flash chamber;

expanding said high pressure steam through a turbine to produce power and low pressure steam.

5. The process according to claim 4 wherein said low pressure steam is at a subatmospheric pressure.

6. The process according to the claim 5 wherein at least a portion of said high pressure steam is at a subatmospheric pressure.

7. An absorption power generating process comprising:

injecting low pressure steam into an absorber chamber;

injecting a rich desiccant into said absorber chamber;

absorbing at least a portion of said low pressure steam into said rich desiccant to release heat from said desiccant and produce a weakened desiccant;

removing at least a portion of said weakened desiccant from said absorber chamber;

vaporizing at least a portion of the water from said weakened desiccant in an atmosphere of air to enrich said weakened desiccant;

transferring said released heat from said absorber chamber to a stream of water to produce high pressure steam;

expanding said high pressure system through a turbine to produce power and low pressure steam;

performing the following steps prior to enriching said weakened desiccant and prior to transferring said heat to said water;

thermally contacting a first portion of said weakened desiccant with said water to produce significantly cooled weakened desiccant;

thermally contacting a second portion of said weakened desiccant with said rich desiccant also to produce cooled weakened desiccant;

thermally contacting a greater portion than said first portion of said cooled weakened desiccant with said water to further cool without overcooling said cooled weakened desiccant.

8. The process according to claim 7 wherein said low pressure steam is at a subatmospheric pressure.

9. The process according to the claim 8 wherein at least a portion of said high pressure steam is at a subatmospheric pressure.

10. An absorption power generating process comprising:

injecting low pressure steam into an absorber chamber;

injecting a rich desiccant into said absorber chamber;

absorbing at least a portion of said low pressure steam into said rich desiccant to release heat from said desiccant and produce a weakened desiccant;

removing at least a portion of said weakened desiccant from said absorber chamber;

introducing said weakened desiccant into a circulating first first loop containing an evaporation zone to drive water from said weakened desiccant into an atmosphere of air to form a richer dessicant;

transferring said richer desiccant from said first loop to a circulating second loop of desiccant richer than said first loop, said second loop also containing an evaporation zone to drive water from said richer desiccant;

transferring said released heat from said absorber chamber to a stream of water to produce high pressure steam;

expanding said high pressure steam through a turbine to produce power and low pressure steam.

11. The process according to claim 10 wherein said low pressure steam is at a subatmospheric pressure.

12. The process according to the claim 11 wherein at least a portion of said high pressure steam is at a subatmospheric pressure.

13. An absorption power generating process comprising:

injecting low pressure steam into an absorber chamber;

injecting a rich desiccant into said absorber chamber;

absorbing at least a portion of said low pressure steam into said rich desiccant to release heat from said desiccant and produce a weakened desiccant;

removing at least a portion of said weakened desiccant from said absorber chamber;

vaporizing at least a portion of the water from said weakened desiccant in an atmosphere of air to enrich said weakened desiccant;

transferring said released heat from said absorber chamber to a stream of water to produce high pressure steam;

expanding said high pressure steam through a turbine to produce power and low pressure steam;

performing the following steps prior to injecting said rich desiccant into said absorber;

injecting residual steam from said absorber chamber into a purge chamber;

injecting said rich desiccant into said purge chamber to absorb steam and to concentrate noncondensible gases;

venting noncondensible gases from said purge chamber.

14. The process according to claim 13 wherein said low pressure steam is at a subatmospheric pressure.

15. The process according to the claim 14 wherein at least a portion of said high pressure steam is at a subatmospheric pressure.

16. An absorption power generating process comprising:

injecting low pressure steam into an absorber chamber at a subatmospheric pressure;

injecting a rich desiccant into said absorber chamber;

absorbing at least a portion of said low pressure steam into said rich desiccant to release heat from said desiccant and produce a weakened desiccant;

removing at least a portion of said weakened desiccant from said absorber chamber;

vaporizing at least a portion of the water from said weakened desiccant in an atmosphere of air to enrich said weakened desiccant;

transferring said released heat from said absorber chamber to a stream of water to produce high pressure steam;

expanding said high pressure steam through a turbine to produce power and low pressure steam;

performing the following steps prior to transferring said heat to said water;

passing a stream of feedwater through a suitable jet ejector to draw a vacuum on said absorber chamber;

passing at least a portion of the exhaust water from said ejector into a separator to separate air from said exhaust water;

feeding said exhaust water from said separator to said to said stream of water to produce said high pressure steam.

17. The process according to the claim 16 wherein at least a portion of said high pressure steam is at a subatmospheric pressure.

18. An absorption power generating process comprising:

injecting low pressure steam into an absorber chamber;

injecting a rich desiccant into a first portion of said absorber chamber;

absorbing at least a portion of said low pressure steam into said rich desiccant to produce an intermediate strength desiccant and to release heat at a relatively high temperature;

passing a major portion of said intermediate desiccant to a second portion of said absorber chamber;

absorbing at least a portion of said low pressure steam into said intermediate desiccant to produce a weakened desiccant and to release heat at an intermediate temperature;

removing at least a portion of said weakened dessicant from said absorber chamber;

vaporizing at least a portion of the water from said weakened desiccant in an atmosphere of air to enrich said weakened desiccant;

transferring a major portion of said high temperature heat to a stream of water in a first boiler to vaporize water to relatively high pressure steam;

transferring a major portion of said intermediate temperature heat to a second boiler to vaporize water to steam at an intermediate pressure;

expanding at least a portion of said high pressure steam through a turbine to produce power and low pressure steam;

expanding at least a portion of said intermediate steam through a turbine to produce power and low pressure steam.

19. The process according to claim 18 wherein said low pressure steam is at a subatmospheric pressure.

20. The process according to the claim 18 wherein at least a portion of said high pressure steam is at a subatmospheric pressure.

21. The process according to claim 18 wherein said high pressure steam is generated in a flash chamber.

* * * * *